US010286412B2

(12) United States Patent
Jin

(10) Patent No.: US 10,286,412 B2
(45) Date of Patent: May 14, 2019

(54) SEALER CIRCULATION SYSTEM

(71) Applicants: HYUNDAI MOTOR COMPANY, Seoul (KR); KIA Motors Corporation, Seoul (KR)

(72) Inventor: Taeheun Jin, Gyeongsan-si (KR)

(73) Assignees: HYUNDAI MOTOR COMPANY, Seoul (KR); KIA Motors Corporation, Seoul (KR)

( * ) Notice: Subject to any disclaimer, the term of this patent is extended or adjusted under 35 U.S.C. 154(b) by 0 days.

(21) Appl. No.: 15/684,641

(22) Filed: Aug. 23, 2017

(65) Prior Publication Data

US 2018/0161790 A1 Jun. 14, 2018

(30) Foreign Application Priority Data

Dec. 14, 2016 (KR) ..... 10-2016-0170813

(51) Int. Cl.

| | |
|---|---|
| ***B05C 11/10*** | (2006.01) |
| ***B05B 7/02*** | (2006.01) |
| ***B05B 12/08*** | (2006.01) |
| ***B05C 5/02*** | (2006.01) |
| ***B05C 21/00*** | (2006.01) |
| ***B05B 13/04*** | (2006.01) |
| ***B05B 15/58*** | (2018.01) |
| *B05B 12/12* | (2006.01) |

(52) U.S. Cl.

CPC ..... *B05B 7/02* (2013.01); *B05B 12/08* (2013.01); *B05B 13/0452* (2013.01); *B05B 15/58* (2018.02); *B05C 5/02* (2013.01); *B05C 11/10* (2013.01); *B05C 11/1015* (2013.01); *B05C 11/1026* (2013.01); *B05C 21/00* (2013.01); *B05B 12/122* (2013.01)

(58) Field of Classification Search

USPC ..... 118/300, 323, 321, 684, 692, 679–681, 118/666, 667, 712

See application file for complete search history.

(56) References Cited

U.S. PATENT DOCUMENTS 6,089,469 A * 7/2000 Fusama ..... B05C 11/1013 239/124

7,707,961 B2 * 5/2010 Alexander ..... B05B 9/002 118/302

* cited by examiner

*Primary Examiner* — Yewebdar T Tadesse

(74) *Attorney, Agent, or Firm* — McDonnell Boehnen Hulbert & Berghoff LLP

(57) ABSTRACT

A sealer circulation system according to an exemplary embodiment of the present disclosure includes: a circulation unit; a temperature compensation unit disposed on the circulation line; a supply line branched from the circulation line; a cylinder disposed on the supply line; a coating gun; and an exhaust line connected to an outlet side of the coating gun. The circulation unit is disposed on the circulation line to circulate the sealer. The temperature compensation unit disposed on the circulation line compensates the temperature of the circulating sealer. The cylinder pressure-feeds a predetermined amount of sealer. The coating gun discharges the sealer supplied from the cylinder to the outside by opening and closing a nozzle.

8 Claims, 7 Drawing Sheets

SEALER CIRCULATION SYSTEM

CROSS-REFERENCE TO RELATED APPLICATION

This application claims priority to and the benefit of Korean Patent Application No. 10-2016-0170813 filed in the Korean Intellectual Property Office on Dec. 14, 2016, the entire contents of which are incorporated herein by reference.

BACKGROUND OF THE DISCLOSURE

(a) Field of the Disclosure

The present disclosure relates to a sealer circulation system that automatically applies a coating of sealer to a roof ditch of a vehicle and includes a circulation line for circulation of a sealer and a temperature sensor provided at a predetermined location.

(b) Description of the Related Art

In a vehicle, a bonding unit that is disposed between a roof and a side panel engages roof molding after spot welding.

When the roof molding is engaged to a ditch portion by a worker, productivity may deteriorate and an installation error may occur.

Recently, a method for automatically applying a coating of sealer to a roof bonding portion instead of using the roof molding has been introduced and accordingly quality of exterior appearance can be improved.

Further, a sealer circulation system that can stably maintain the temperature of the sealer, circulate the sealer, improve the quality of the coated sealer, and improve the coating accuracy has been researched and developed.

The above information disclosed in this Background section is only for enhancement of understanding of the background of the disclosure and therefore it may contain information that does not form the prior art that is already known in this country to a person of ordinary skill in the art.

SUMMARY OF THE DISCLOSURE

The present disclosure has been made in an effort to provide a sealer circulation system that can automatically apply a coating of sealer to a roof ditch of a vehicle, stably maintain the temperature of a circulating sealer by providing a temperature sensor, and improve productivity and quality at the same time.

A sealer circulation system according to an exemplary embodiment of the present disclosure includes: a circulation unit disposed on a circulation line to circulate the sealer; a temperature compensation unit disposed on the circulation line to compensate a temperature of the circulating sealer; a supply line branched from the circulation line; a cylinder disposed on the supply line to pressure-feed a predetermined amount of sealer; a coating gun that discharges the sealer supplied from the cylinder to the outside by opening and closing a nozzle; and an exhaust line connected to an outlet side of the coating gun through which any sealer remaining after discharging from the coating gun is exhausted.

The coating gun may be provided with a first temperature sensor that senses the temperature of the sealer to be discharged.

The cylinder may be provided with a second temperature sensor that senses the temperature of a sealer to be pressure-fed.

An inlet of the cylinder may be provided with a third temperature sensor that senses a temperature of a sealer that enters into the cylinder.

An outlet of the temperature compensation unit may be provided with a fourth temperature sensor that senses a temperature of a sealer discharged from the temperature compensation unit.

An inlet of the temperature compensation unit may be provided with a fifth temperature sensor that senses a temperature of sealer that enters into the temperature compensation unit.

The temperature compensation unit may be provided with a sixth temperature sensor that senses the temperature of the sealer that flows through the inside of the temperature compensation unit.

The sealer circulation system may include a controller that controls the circulation unit, the temperature compensation unit, the cylinder, and the coating gun by using the temperature of the sealer that is sensed by the first temperature sensor, the second temperature sensor, the third temperature sensor, the fourth temperature sensor, the fifth temperature sensor, or the sixth temperature sensor.

A supply valve that controls supply of the sealer may be provided at a rear end of the cylinder in the supply line.

A first circulation valve that controls the circulating sealer may be provided in a direction to which the sealer flows at a predetermined location where the circulation line branches to the supply line.

A second circulation valve that controls the sealer exhausted from the coating gun may be provided in the exhaust line.

The sealer circulation system may further include a charging unit that charges the sealer into the circulation line through a charging line that is connected with the circulation line at an intake side of the circulation unit.

The controller may control the supply valve, the first circulation valve, the second circulation valve, and the charging unit using the temperature of the sealer, sensed by the first temperature sensor, the second temperature sensor, the third temperature sensor, the fourth temperature sensor, the fifth temperature sensor, or the sixth temperature sensor.

The temperature compensation unit may include: a thermoelectric element provided to apply heat to the circulating sealer or absorb heat from the sealer; a heat radiation panel provided to absorb heat from the sealer; a heat radiation fan discharging heat of the heat radiation panel to the outside; and a cooling block provided adjacent to the thermoelectric element to absorb heat.

In the sealer circulation system according to the exemplary embodiment of the present disclosure, a temperature sensor is provided in predetermined locations with respect to the coating gun, the cylinder, and the temperature compensation unit. Based on the temperature sensed by the temperature sensor, a coating of sealer is applied and the sealer is circulated so that the temperature of the sealer can be more stably maintained and accurately controlled.

Accordingly, the quality of the sealer coating that is applied and the circulating sealer can be stably improved.

DETAILED DESCRIPTION OF THE EMBODIMENTS

Figure 1:
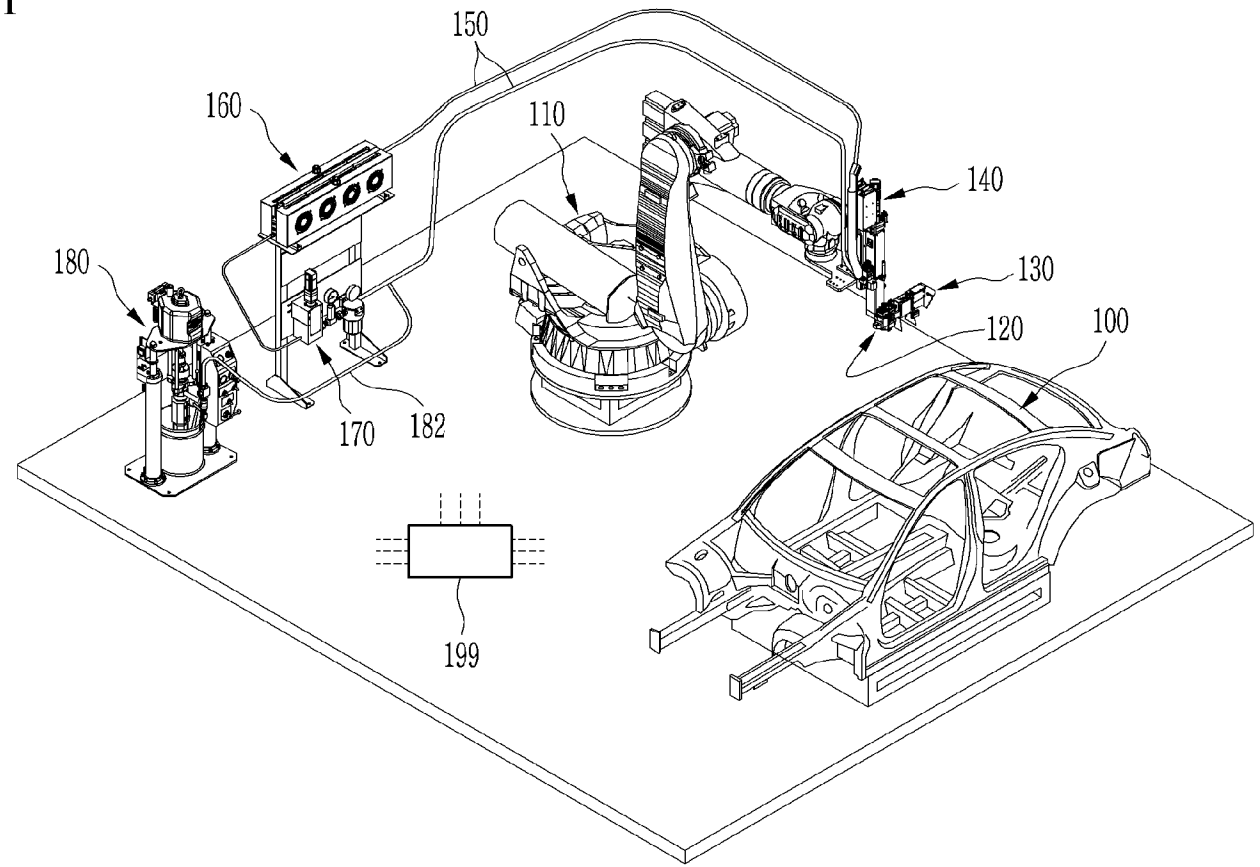
FIG. 1 is a schematic diagram of a sealer circulation system according to an exemplary embodiment of the present disclosure.

Hereinafter, an exemplary embodiment of the present disclosure will be described in detail with reference to the accompanying drawings.

In addition, the size and thickness of each configuration shown in the drawings are arbitrarily shown for understanding and ease of description, but the present disclosure is not limited thereto, and the thickness of layers, films, panels, regions, etc., are exaggerated for clarity.

A part irrelevant to the description will be omitted to clearly describe the exemplary embodiment of the present disclosure, and the same elements will be designated by the same reference numerals throughout the specification.

In a description below, names of constituent elements are used as "a first . . . ", "a second . . . ", and the like, but the name of the constituent element is not limited to the order.

FIG. 1 is a schematic diagram of a sealer circulation system according to an exemplary embodiment of the present disclosure.

Referring to FIG. 1, a sealer circulation system includes a filling unit 180, a filling line 182, a circulation unit 170, a temperature compensation unit 160, a circulation line 150, a robot 110, a quantitative discharging unit 140, a coating gun 120, a vision 130, a vehicle body 100, and a controller 199 as main constituent elements.

The charging unit 180 charges the sealer to the circulation line 150 through the charging line 182, and the circulation unit 170 circulates the sealer along the circulation line 150. The temperature compensation unit 160 compensates the temperature of the sealer that circulates along the circulation line 150 to be within a predetermined temperature range.

The quantitative discharging unit 140 transfers a predetermined amount of sealer to the coating gun 120. The coating gun 120 discharges the sealer to the outside through a nozzle 260. The vision 130 senses the shape of the vehicle 100 and senses the shape of the coated sealer.

The coating gun 120 and the vision 130 are disposed at a front end of an arm of the robot 110, and the robot 110 may move the coating gun 120 and the vision 130 to a predetermined route.

The controller 199 controls the charging unit 180, the circulation unit 170, the temperature compensation unit 160, the quantitative discharging unit 140, and the coating gun 120, senses the shape and profile of the vehicle body 100 through the vision 130, calculates quality of the coated sealer, and controls the robot 110.

The control unit 199 may be implemented as one or more of microprocessors that are operated by a predetermined program, and the predetermined program may include a series of commands for performing a method according to an exemplary embodiment of the present disclosure that will be described later.

Figure 2:
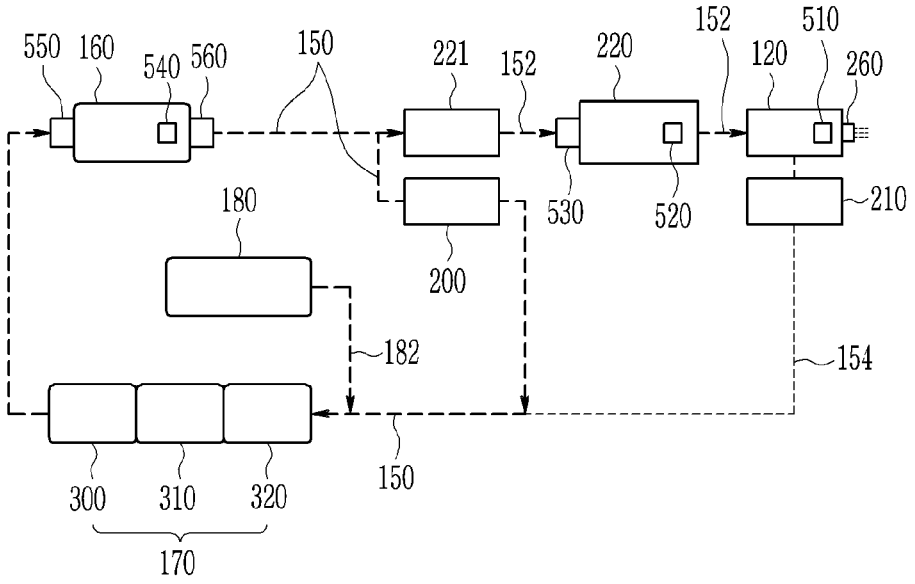
FIG. 2 is a schematic diagram of the flow of a sealer in the sealer circulation system according to the exemplary embodiment of the present disclosure.

FIG. 2 is a schematic diagram of the flow of the sealer in the sealer circulation system according to the exemplary embodiment of the present disclosure.

Referring to FIG. 2, the circulation line 150 forms one closed loop, and the temperature compensation unit 160, a first circulation valve 200, and the circulation unit 170 are disposed at predetermined locations of the circulation line 150. In addition, the charging line 182 connects the circulation line 150 and the charging unit 180 with each other.

The supply line 152 is branched from the circulation line 150 at a rear end of the supply valve 221 and then connected to a sealer inlet of the coating gun 120.

A cylinder 220 is provided between the supply valve 221 and the coating gun 120, and the cylinder 220 pressure-feeds the sealer supplied through the supply valve 221 to the coating gun 120.

An exhaust line 154 is joined to the rear end of the first circulation valve 200 of the circulation line 150 at an outlet side of the coating gun 120.

In addition, a second circulation valve 210 is provided in the outlet side of the coating gun 120 in the exhaust line 154.

In a mode during which the sealer is continuously sprayed from the coating gun 120, the charging unit 180 charges the sealer to the circulation line 150 through the charging line 182. Also in this mode, the sealer sequentially circulates through the filter 320, the compression sensor 310, the circulation pump 300, the temperature compensation unit 160, and the first circulation valve 200.

In addition, the sealer is supplied back to the coating gun 120 through the supply valve 221 and the cylinder 220 and then is sprayed through the nozzle 260 to coat a ditch area of the vehicle body 100.

In the exemplary embodiment of the present disclosure, the coating gun 120 may open and close the nozzle 260 using a valve. A first temperature sensor 510 that senses the temperature of the sealer discharged through the nozzle 260 is provided in the coating gun 120.

The cylinder 220 may operate by rotation of a pressure-feeding motor. The pressure-feeding motor moves a piston of the cylinder 220 through a ball screw to pressure-feed a predetermined amount of sealer to the coating gun 120.

A second temperature sensor 520 that senses the temperature of the pressure-fed sealer is provided in the cylinder 220. A third temperature sensor 530 that senses the temperature of the sealer that is fed into the cylinder 220 is provided at an inlet of the cylinder 220.

A temperature sensor is disposed at a predetermined location in the temperature compensation unit 160. More specifically, a sixth temperature sensor 540 that senses the temperature of the circulating sealer is provided in the temperature compensation unit 160.

In addition, a fourth temperature sensor 560 is provided at an outlet of the temperature compensation unit 160 through which the sealer is discharged to the outside. A fifth temperature sensor 550 is provided in an inlet to the temperature compensation unit 160 through which the sealer is fed into the temperature compensation unit 160.

The control unit 199 receives temperatures of the sealer from the fifth temperature sensor 550, the sixth temperature sensor 540, the fourth temperature sensor 560, the third temperature sensor 530, the second temperature sensor 520, and the first temperature sensor 10, respectively. The control unit 199 controls the temperature of the sealer flowing through the circulation line 150, the supply line 152, and the exhaust line 154 based on the received temperatures and also controls the temperature of the sealer discharged from the coating gun 120.

Further, the control unit 199 controls operation of each of the temperature compensation unit 160, the supply valve 221, the first circulation valve 200, the cylinder 220, the coating gun 120, the second circulation valve 210, the charging unit 180, and the circulation unit 170 using the temperatures received from the respective temperature sensors.

Figure 3:
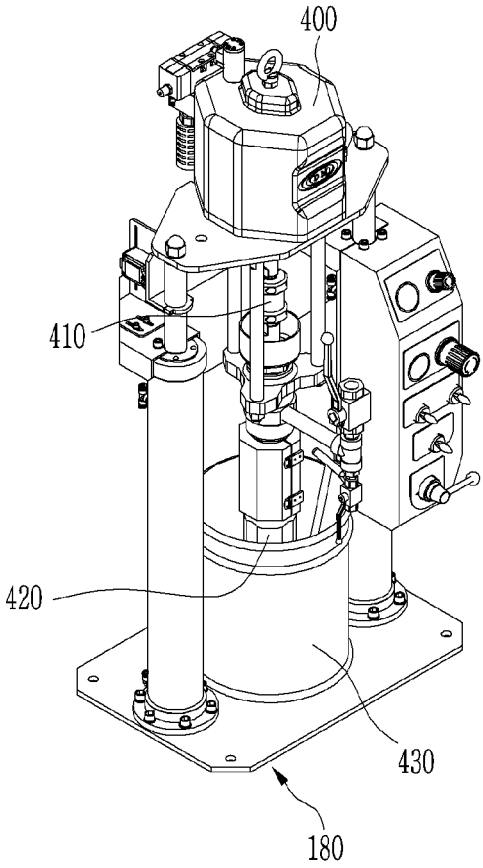
FIG. 3 is a partial perspective view of a filling unit in the sealer circulation system according to the exemplary embodiment of the present disclosure.

FIG. 3 is a perspective view of part of the charging unit in the sealer circulation system according to the exemplary embodiment of the present disclosure.

Referring to FIG. 3, the charging unit 180 includes a sealer storage unit 430, a charging pump 420, a coupling 410, and a charging motor 400 as constituent elements.

The charging motor 400 provides a rotation force to the charging pump 420 through the coupling 410. The charging pump 420 supplements the sealer to the circulation line 150 through the charging line 182 by pumping the sealer stored in the sealer storage unit 430.

Figure 4:
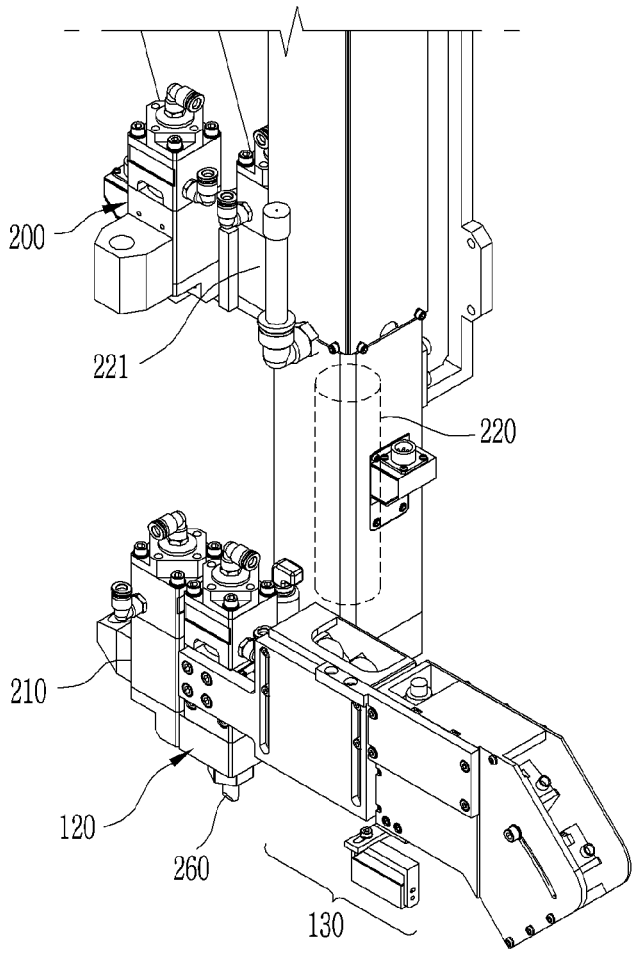
FIG. 4 is a partial perspective view of a coating gun, a vision, and a quantitative discharging unit in the exemplary embodiment of the present disclosure.

FIG. 4 is a perspective view that partially illustrates the coating gun 120, the vision 130, and the quantitative discharging unit 140 in the sealer circulation system according to the exemplary embodiment of the present disclosure.

Referring to FIG. 4, the quantitative discharging unit 140 includes a discharge motor (not shown), a ball screw (not shown), and the cylinder 220. The discharge motor pressure-feeds the sealer charged in the cylinder 220 to the coating gun 120 through the ball screw.

The coating gun 120 is disposed at a front end of the cylinder 220, and the nozzle 260 through which the sealer is discharged to the outside is disposed at a lower end of the coating gun 120. The supply valve 221 and the first circulation valve 200 are disposed at one side of the quantitative discharging unit 140, and the second circulation valve 210 is disposed at one side of the coating gun 120.

Figure 5:
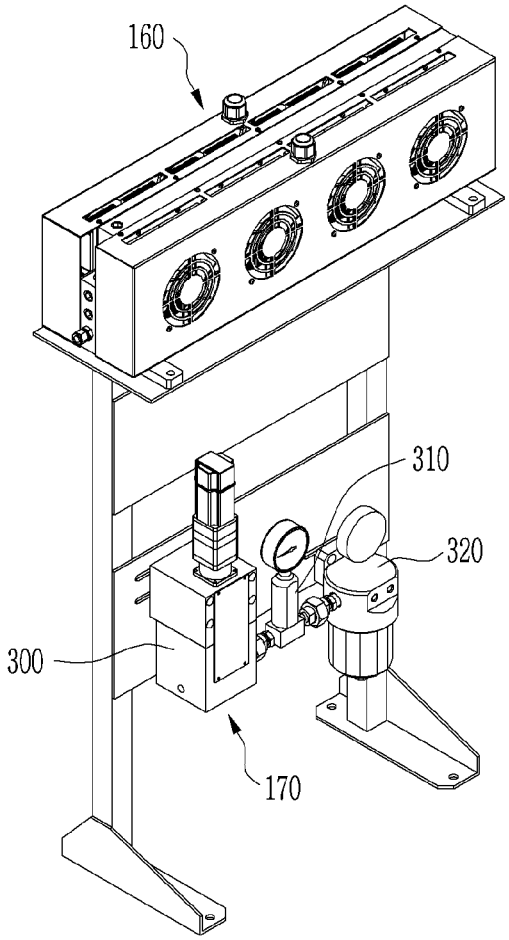
FIG. 5 is a partial perspective view of a temperature compensation unit and a circulation unit in the sealer circulation system according to the exemplary embodiment of the present disclosure.

FIG. 5 is a perspective view that partially illustrates the temperature compensation unit 160 and the circulation unit 170 in the sealer circulation system according to the exemplary embodiment of the present disclosure.

Referring to FIG. 5, the circulation unit 170 includes a filter 320, a pressure sensor 310 and a circulation pump 300 as constituent elements. The filter 320 filters any foreign substance from the sealer that circulates the circulation line 150. The pressure sensor 310 senses the pressure of the circulating sealer, and the circulation pump 300 circulates the sealer along the circulation line 150.

The temperature compensation unit 160 controls the temperature of the sealer that circulates along the circulation line 150 within a predetermined temperature range. For the temperature sensing, the temperature compensation unit 160 includes the above-described temperature sensors.

Further, the temperature compensation unit 160 includes a heater for heating the sealer, a cooler for cooling the sealer, and a heat radiation unit for heat radiation. The heater and the cooler may use thermoelectric elements and the heat radiation unit may include a heat radiation panel that absorbs heat and a heat radiation fan.

Figure 6:
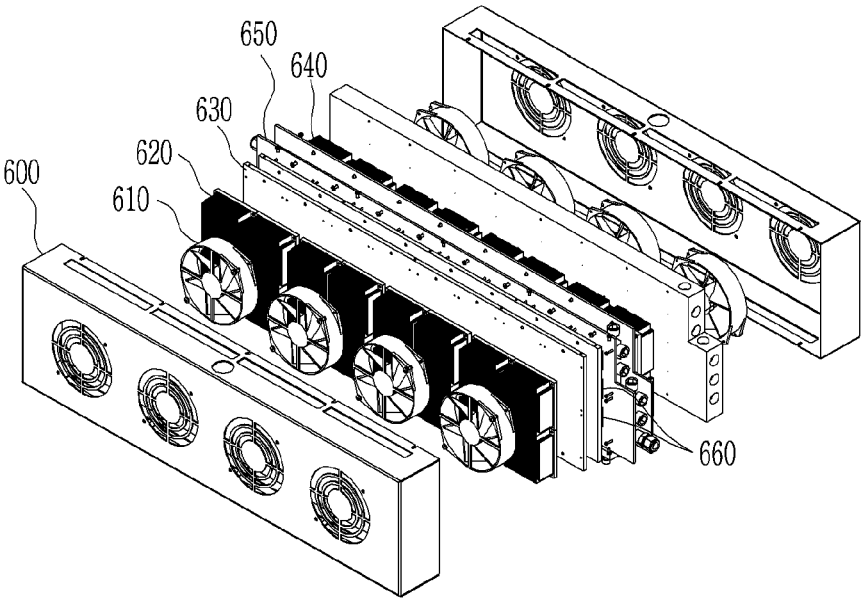
FIG. 6 is an exploded perspective view of part of the temperature compensation unit in the sealer circulation system according to the exemplary embodiment of the present disclosure.

FIG. 6 is a partially exploded perspective view of the temperature compensation unit 160 in the sealer circulation system according to the exemplary embodiment of the present disclosure.

Referring to FIG. 6, the temperature compensation unit 160 includes a cover 600, a heat radiation fan 610, a heat radiation panel 620, a side panel 630, a cooling block 640, an insulator 650, and a thermoelectric element 660 as constituent elements.

The thermoelectric element 660 applies heat to the sealer or cools the sealer according to a current flow. The cooling block 640 cools the thermoelectric element 660 or the sealer. An additional cooling fluid may pass through the cooling block 640.

The insulator 650 blocks heat, the side panel 630 is disposed between the heat radiation panel 620 and the thermoelectric element 660, the heat radiation panel 620 absorbs heat from the sealer, and the heat radiation fan 610 cools the heat radiation panel 620. In addition, the cover 600 is provided with a path through which air generated from the heat radiation fan 610 is transferred to the outside.

Figure 7:
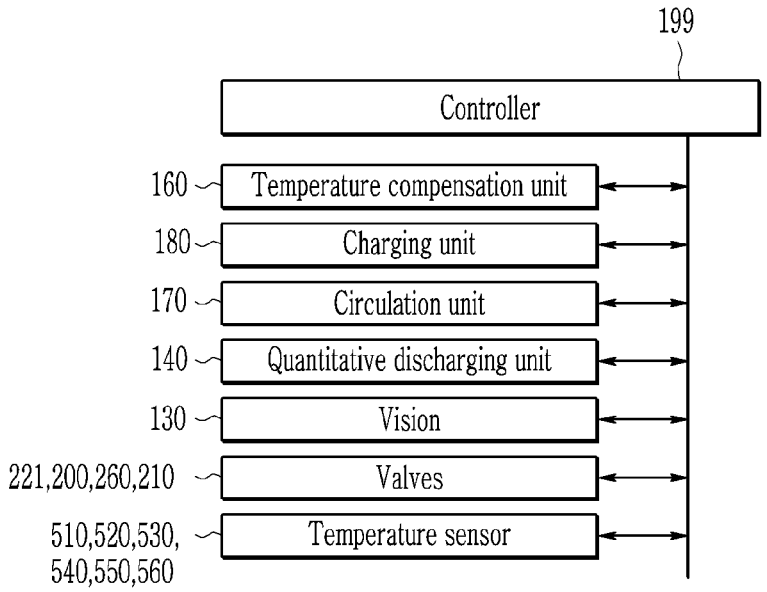
FIG. 7 is a schematic diagram of the sealer circulation system according to the exemplary embodiment of the present disclosure.

FIG. 7 is a schematic diagram of the sealer circulation system according to the exemplary embodiment of the present disclosure.

Referring to FIG. 7, the control unit 199 can control the flow of the sealer using the first circulation valve 200, the second circulation valve 210, the supply valve 221, the cylinder 220, and the coating gun 120 based on the temperature signals transmitted from the temperature sensors.

In addition, the control unit 199 controls the temperature compensation unit 160, the charging unit 180, the circulation unit 170, and the quantitative discharging unit 140, respectively, according to temperature information and a circulation mode of the sealer. Further, the control unit 199 may determine the shape of the vehicle and the quality of the coated sealer by using a signal transmitted from the vision 130.

While this disclosure has been described in connection with what is presently considered to be practical example embodiments, it is to be understood that the disclosure is not limited to the disclosed embodiments. On the contrary, it is intended to cover various modifications and equivalent arrangements included within the spirit and scope of the appended claims.

What is claimed is:

1. A sealer circulation system comprising:

a circulation unit disposed on a circulation line to circulate a sealer;

a temperature compensation unit disposed on the circulation line to compensate a temperature of the circulating sealer;

a supply line branched from the circulation line;

a cylinder disposed on the supply line to pressure-feed a predetermined amount of sealer;

a coating gun that discharges the sealer supplied from the cylinder to the outside by opening and closing a nozzle; and an exhaust line connected to an outlet side of the coating gun through which any sealer remaining after discharging from the coating gun is exhausted;

wherein the coating gun is provided with a first temperature sensor that senses the temperature of the sealer to be discharged;

wherein the sealer circulation system further comprises a controller that controls the circulation unit, the temperature compensation unit, the cylinder, and the coating gun by using the temperature of the sealer that is sensed by the first temperature sensor, a second temperature sensor, a third temperature sensor, a fourth temperature sensor, a fifth temperature sensor, or a sixth temperature sensor;

wherein a supply valve that controls supply of the sealer is provided at a rear end of the cylinder in the supply line;

wherein a first circulation valve that controls the circulating sealer is provided in a direction in which the sealer flows at a predetermined location where the circulation line branches to the supply line;

wherein a second circulation valve that controls the sealer exhausted from the coating gun is provided in the exhaust line; and wherein the sealer circulation system further comprises a charging unit that charges the sealer into the circulation line through a charging line that is connected with the circulation line at an intake side of the circulation unit.

2. The sealer circulation system of claim 1, wherein the second temperature sensor is provided in the cylinder, and wherein the second temperature sensor senses the temperature of the sealer to be pressure-fed.

3. The sealer circulation system of claim 1, wherein the third temperature sensor is provided at an inlet of the cylinder, wherein the third temperature sensor senses the temperature of the sealer that enters into the cylinder.

4. The sealer circulation system of claim 1, wherein the fourth temperature sensor is provided at an outlet of the temperature compensation unit, wherein the fourth temperature sensor senses the temperature of sealer discharged from the temperature compensation unit.

5. The sealer circulation system of claim 1, wherein the fifth temperature sensor is provided at an inlet of the temperature compensation unit, wherein the fifth temperature sensor senses the temperature of sealer that enters into the temperature compensation unit.

6. The sealer circulation system of claim 1, wherein the sixth temperature sensor is provided in the temperature compensation unit, wherein the sixth temperature sensor senses a temperature of sealer that flows through the inside of the temperature compensation unit.

7. The sealer circulation system of claim 1, wherein the controller controls the supply valve, the first circulation valve, the second circulation valve, and the charging unit using the temperature of the sealer, sensed by the first temperature sensor, the second temperature sensor, the third temperature sensor, the fourth temperature sensor, the fifth temperature sensor, or the sixth temperature sensor.

8. The sealer circulation system of claim 1, wherein the temperature compensation unit comprises:

a thermoelectric element provided to apply heat to the circulating sealer or absorb heat from the sealer;

a heat radiation panel provided to absorb heat from the sealer;

a heat radiation fan discharging heat of the heat radiation panel to the outside; and a cooling block provided adjacent to the thermoelectric element to absorb heat.

* * * * *